United States Patent [19]

Kemper

[11] 4,030,947

[45] June 21, 1977

[54] HEATING TREATMENT METHOD AND SYSTEM OF UTILIZING SAME

[76] Inventor: Eugene L. Kemper, 38520 Delta Drive, Mount Clemens, Mich. 48043

[22] Filed: Sept. 10, 1975

[21] Appl. No.: 612,190

[52] U.S. Cl. ..... 148/12.9; 148/32.5; 148/159; 266/130

[51] Int. Cl.[2] ..... C21D 1/04

[58] Field of Search ..... 148/12.7 A, 12.7 R, 148/12.9, 158, 159, 160, 32.5, 12.7 C; 266/4 A

[56] References Cited

UNITED STATES PATENTS

| | | | |
|---|---|---|---|
| 1,656,502 | 1/1928 | Sander | 148/159 |
| 1,858,092 | 5/1932 | Hybinette | 148/159 |
| 3,171,760 | 3/1965 | Vernam et al. | 148/159 |
| 3,304,209 | 2/1967 | Anderson et al. | 148/32.5 |
| 3,414,406 | 12/1968 | Doyle et al. | 75/142 |
| 3,868,279 | 2/1975 | Nachman et al. | 148/160 |

*Primary Examiner*—W. Stallard

*Attorney, Agent, or Firm*—Irving M. Weiner; Pamela S. Austin

[57] ABSTRACT

A method and system for heat treating metallic substances, especially alloys, and the products obtained thereby. The alloy is subjected to solution heat treating in a fluid media, after which it is quenched in a fluid quenching media. This is followed by natural aging, and a two step artificial aging process. The total time for the process is less than that of conventional techniques, and yet the final resulting alloy has superior physical and mechanical properties. Optionally, ultrasonic treatment can be used in one or more of the steps of the method.

16 Claims, 2 Drawing Figures

HEATING TREATMENT METHOD AND SYSTEM OF UTILIZING SAME

The present invention relates generally to a method and system for heat treating a metallic substance, and the product obtained thereby. In particular, the present invention relates to a novel method and system for heat treating nonferrous alloys, and the product obtained thereby.

BACKGROUND OF THE INVENTION

Heretofore, it was known that, in heat treatment, steel could be hardened to the desired degree within certain limits by controlling the dispersion of iron carbide in ferrite or by forming a metastable solid solution of carbon in body-centered tetragonal iron. It has also been known that the finer the dispersion, the harder the steel.

Notwithstanding the foregoing, for many years the properties of other alloys and metals could not be altered except by cold working and annealing to produce recrystallization. Then, in 1911 there was published the results of tests on a certain aluminum allow revealing that the strength of the particular aluminum allow involved increased with aging at room temperature after a quenching treatment. Since that discovery, the change in properties on aging after suitable treatment was observed in many alloys and was put to practical use. The phenomenon of the increase of hardness and strength as a function of time is called "age hardening".

A probable explanation of the phenomenon has given rise to the use of the term "precipitation hardening". This term appears to be adequate even though the precise mechanism by which this hardening takes place is not too well understood.

The treatment of alloys for precipitation hardening requires very careful control, because in most cases the temperature at which the homogeneous solid solution is attainable lies within a very narrow range. Burning, embrittlement, or actual fusion may result from heating above this temperature. On the other hand, too low a temperature will permit the complete separation of a portion of the second phase in the grain boundaries, thus preventing the attainment of maximum hardening. Complete homogenization at the proper temperature requires proper timing. This process is known as "solution heat treating". The type of alloy being treated, the section of the part, and the temperature employed will determine the time element involved. The time may vary from ten to fifteen minutes up to a matter of several days. With some, if not most, alloys it is necessary to transfer the alloy parts from the heating furnace to the quenching bath in a very short time. Gross precipitation of the phase which is to bring about hardening may occur if there is delay in this transfer. In some alloys, such as nickel-silicon and iron-copper, precipitation does not occur very rapidly. Therefore, air cooling may be sufficiently rapid so that maximum hardening can be attained by artificial aging.

The precipitation treatment which is a combination of aging temperature and aging time, is rather critical for some alloys. As a general rule, a decrease of the aging temperature requires a considerable increase of the time of aging. Lower aging temperatures bring about appreciable increases in strength without materially decreasing the ductility in some alloys. This is evident in some aluminum-copper alloys.

As indicated hereinabove, the solution heat treating for aluminum alloys has been known for many years. Heat treatable aluminum alloys are generally heated in a range of from 750° F to as high as approximately 1000° F. This is followed by an aqueous solution quench, or forced air cooling of the aluminum product. This in turn is followed by a room temperature aging process, or an elevated temperature artificial aging process to obtain full physical properties from the alloys.

Gas-heated or electric-heated forced convection ovens have been used for the solution heating as well as artificial aging. The conventional aqueous quenching tanks are usually closely adjacent to the solution heat treating oven so that a minimum time is required to transfer the aluminum alloy from the solution heat treating to the quench.

Molten salt bath furnaces have been used for the solution heat treating requirements. Usually, a binary mixture of sodium nitrate and potassium nitrate at temperatures between 750° F and 1000° F are used. The conventional aqueous quench tanks are adjacent to the salt bath furnace to minimize transfer time from the solution heat treat furnace. Conventionally, forced air convection ovens are used for the aging treatment.

In recent years, the aluminum industry has developed aluminum alloys which produce desirable physical properties but do not require rapid cooling. Examples of such newer aluminum alloys are Alcoa Aluminum Alloy 7005 and X-7046 both of which are heat-treatable aluminum-zinc-magnesium alloys. Alloy 7005 is disclosed in "Alcoa Green Letter: Alcoa Aluminum Alloy 7005", GL 198 (Rev. 1–75) and by U.S. Pat. No. 3,304,209. Alloy X-7046 is disclosed by an Alcoa publication entitled "Bumpology", E28–13534. The usual heat treatment practice for alloy X-7046 extrusions and sheet comprises: solution heat treat for fifteen minutes at 750° F plus or minus 50° F in a continuous furnace; fan quench at a minimum rate to exceed 4° F per second; natural age at room temperature for eight hours minimum; and artificially age for three hours at 200° F plus or minus 10° F, followed by eight hours at 275° F plus or minus 10° F.

The above-mentioned Alloy 7005 may be thermally treated with the process disclosed by U.S. Pat. No. 3,171,760 which is believed to involve a cooling rate from 750° F in a forced air quench system of approximately 10° F per second, followed by a three day aging at room temperature, which in turn is followed by an artificial aging cycle.

The prior art is further exemplified by U.S. Pat. Nos. 3,304,209; 3,414,406 and 3,868,279.

The advantage of the air quench thermal treatment process to the aforesaid newer alloys is that it minimizes the distortion of the fabricated assemblies by virtue of the fact that the treatment eliminates the need for aqueous quenching. However, one of the disadvantages is the long-natural and artificial aging time requirements. In addition, with respect to the alloy X-7046, full physical properties on section thicknesses is required for many components, such as automotive bumper components, and are not necessarily being met due to the inability of cooling the alloy rapidly enough with forced room temperature air. These properties can be improved by aqueous quenching, but this causes distortion which is not acceptable. Such distortion could be minimized by re-striking the components on appropriate dies, but this involves an additional operation which adds to the total cost of the process.

SUMMARY OF THE INVENTION

The present invention avoids the disadvantages mentioned hereinabove, and in particular retains the advantages mentioned hereinabove while at the same time achieving shorter overall thermal treating times, greater tensile ultimate strength, greater tensile yield strength, harder final product, and/or greater energy efficiencies.

The terminology "metallic substance" as used herein is intended to connote metals, alloys, compounds formed between two or more metals, compounds formed between metals and metalloids, and all other compositions which possess metallic characteristics.

The terminology "fluid solution-heat-treat media" as used herein is intended to connote salts, oils, aqueous solutions of salt, mercury, water, air, liquid air, and any other flowable material suitable for solution heat treating.

The terminology "fluid quenching media" as used herein is intended to connote salts, oils, mercury, and any other flowable quenching media capable of being liquid at approximately 350° F, but excluding any quenching media wherein the primary component is water or air.

The present invention provides a method for heat treating a metallic substance, comprising the steps of solution heat treating the metallic substance by causing contact between the metallic substance in a predetermined fluid solution-heat-treat media. This is followed by quenching the solution heat treated metallic substance by causing contact between the solution heat treated metallic substance and a predetermined fluid quenching media. The quenching step may be followed by naturally aging the metallic substance, which in turn may be followed by artificially aging the metallic substance.

The present invention also provides a system for carrying out the novel method for heat treating a metallic substance, comprising, in combination, first means for solution heat treating a metallic substance, second means for quenching the solution heat treated metallic substance, third means for transferring the metallic substance between said first and second means, fourth means for naturally aging the metallic substance, fifth means for transferring the metallic substance between the second and fourth means, sixth means for performing a first artificial aging of the metallic substance, seventh means for transferring the metallic substance between the fourth and sixth means, eighth means for performing a second artificial aging of the metallic substance, and ninth means for transferring the metallic substance between the sixth and eighth means.

In accordance with a preferred embodiment of the present invention, the present invention provides a method as set forth hereinabove wherein the metallic substance comprises an aluminum alloy, and including the steps of solution heat treating the aluminum alloy by immersing the aluminum alloy in a molten salt media of approximately 20 minutes, followed by quenching the solution heat treated aluminum alloy by immersing the aluminum alloy in a predetermined molten salt quenching media. The molten salt quenching media includes a salt selected from the group consisting of sodium nitrate, potassium nitrate, sodium nitrite, potassium nitrite, sodium chloride, and binary, ternary, quaternary and penternary mixtures of the foregoing salts. This is followed by a natural aging of the alloy for no more than four hours, which in turn is followed by a first artificial aging of the alloy for no more than three hours at a first predetermined artificial aging temperature. This in turn is followed by a second artifical aging of the alloy for no more than six hours at a second predetermined artificial aging temperature.

According to a feature of the present invention, ultrasonic energy may be used in the quenching media, in the time period after quenching, and/or in the first artificial aging step.

In accordance with a preferred embodiment of the present invention there is provided a total molten salt bath with a unique salt quench system, as opposed to convection ovens and air quench techniques as mentioned hereinabove.

The present invention also provides a novel pre-programmed continuous system for carrying out the novel method with a minimum of downtime.

DETAILED DESCRIPTION OF SOME PREFERRED EMBODIMENTS OF THE PRESENT INVENTION

Before explaining the present invention in detail, it is to be understood that the present invention is not to be limited in its application or uses or arrangement to the details of construction and equipment and arrangement of parts as illustrated in the accompanying drawings, because the present invention is capable of other embodiments, variations and modifications, and are being practiced or carried out in various ways. Furthermore, it is to be understood that the phraseology and terminology employed herein is for the purpose of description and illustration only, and not for the purpose of limitation.

Some exemplary embodiments of the present invention will be described hereinbelow with reference to sheet material of the Alloy X-7046 which is a heat-treatable, aluminum-zinc-magnesium alloy. Presently known techniques for heat treating this type of alloy involves a complete thermal treating cycle time of from 14 to 14½ hours. In accordance with one embodiment of the present invention, the novel method will reduce the present 14–14½ hour cycle by 6 to 6½ hours and yet provide superior physical properties than now being obtained with the presently known treatment.

Figure 1:
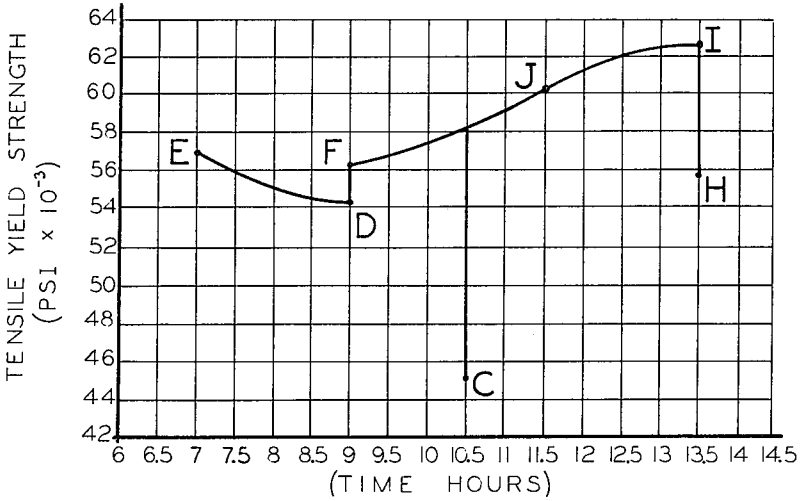
FIG. 1 illustrates a plot of the tensile yield strength as a function of the total time of the process employed.

With reference to FIG. 1, there is depicted a graph showing a plot of tensile yield strength as a function of time for seven parts or samples designated "C", "D", "E", "F", "H", "I" and "J". The data for the various heat treatment steps of the several samples are set forth in Table I appearing on the next page of the present specification. Special attention is directed to sample "H" which represents a sample which has been thermally treated according to the existing conventional technique using an air quenching step. It is also noteworthy that all of the samples processed in accordance with the present invention, viz., samples "D", "E", "F", "I" and "J" acquire a Rockwell hardness which is greater than that of sample "H".

Sample "C" has been included in Table I to demonstrate that the present invention requires a natural aging step after quenching in a predetermined fluid quenching media which, is defined hereinabove, excludes any quenching media wherein the primary component is water or air. The conventional sample "H" thus has greater tensile ultimate strength, tensile yield strength, and hardness values than that of sample "C" which was prepared with the omission of the natural aging step.

TABLE I

| SAMPLE | SOLUTION HEAT TREATMENT | | ISOQUENCH | | NATURAL AGING | | FIRST ARTIFICIAL AGING | | SECOND ARTIFICIAL AGING | | TENSILE ULTIMATE STRENGTH | TENSILE YIELD STRENGTH | ELONGATION | HARDNESS |
|---|---|---|---|---|---|---|---|---|---|---|---|---|---|---|
| | temp. °F | time min. | temp. | time | temp. | time hrs. | temp. °F | time hrs. | temp. °F | time hrs. | psi | psi | % | Rockwell F scale |
| C | 750 | 20 | 350° F salt & $H_2O$ | 1 hr. | — | — | 250 | 3 | 300 | 6 | 53,800 | 45,000 | 17.5 | 93–94 |
| | " | " | " | bath 20 sec. | room temp. | 4 | " | 1.5 | " | 3 | 61,700 | 56,000 | 16.5 | 99–100 |
| E | " | " | " | " " | " "& | 2 | " | " | " | " | 63,500 | 59,300 | 17 | 100–101 |
| F | " | " | " | " " | ultra-sonics | 4 | " | " | " | " | 63,300 | 58,500 | 16.5 | 99–99 |
| H | " | " | 4°/sec in air | to 400° F | room temp. | " | " | 3 | " | 6 | 62,600 | 57,300 | 17.5 | 95–96 |
| I | " | " | 350° F salt & $H_2O$ | bath 20 sec. | " "& | " | " | " | " | " | 68,000 | 64,100 | 17 | 101–102 |
| J | " | " | " | " " | ultra-sonics | 2 | " | " | " | " | 67,000 | 62,700 | 18 | 101–102 |

Attention is now directed to the data pertaining to sample "E" which was prepared in accordance with the present invention in a total treatment time which was approximately 6½ hours less than that of the total treatment time for conventional sample "H". Nevertheless, the product obtained in accordance with sample "E" possesses greater tensile ultimate strength, greater tensile yield strength, and greater hardness than that of conventional sample "H". Because it is a primary object of the present invention to perform the heat treatment process in less time than that of conventional techniques, and to do so with a reduction in the required floor space and capital cost, the following description in connection with FIG. 2 will relate to the processing of sample "E".

Figure 2:
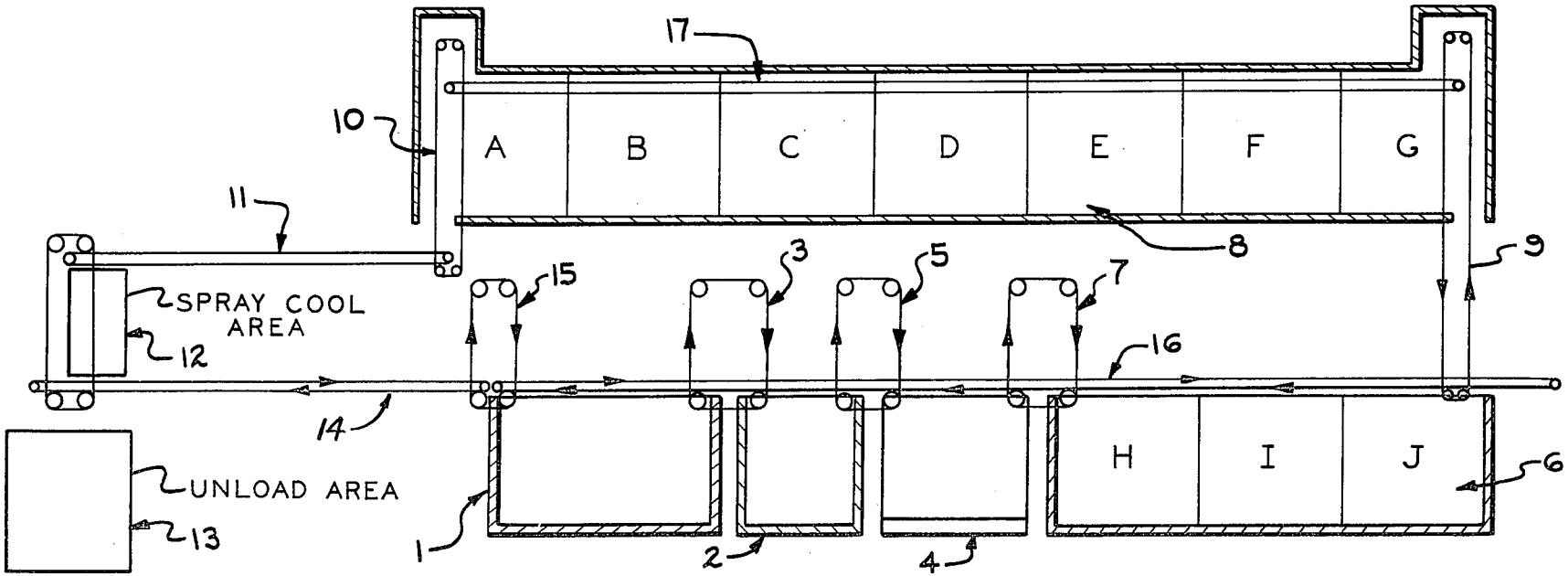
FIG. 2 illustrates a first possible embodiment of the system for carrying out novel method with its programmed sequenching for alloy sample "E".

With reference to FIG. 2 there is illustrated an exemplary system for carrying out the method in accordance with the principles of the present invention. The exemplary system depicted in FIG. 2 includes first means, such as a solution heat treatment furnace 1, for solution heat treating a metallic substance, such as an aluminum-zinc-magnesium alloy. Closely adjacent to the solution treatment furnace 1 there is positioned second means, such as a quench tank 2, for quenching the solution heat treated alloy.

There is also provided third means, such as a fast-transfer station conveyor 3, for transferring the heat treated alloy between the furnace 1 and the quench tank 2.

Closely adjacent to the quench tank 2 there is provided fourth means, such as a natural aging tank 4, for naturally aging tank 4, for naturally aging the quenched alloy. There is also provided fifth means such as a parallel chain transfer conveyor 5, for transferring the quenched alloy between the quench tank 2 and the natural aging tank 4.

Adjacent to the natural aging tank 4 there is provided sixth means, such as a multizoned first artificial aging over 6, for performing a first artificial aging of the naturally-aged alloy. There is also provided seventh means, such as a parallel chain transfer conveyor 7, for transferring the naturally-aging alloy between the natural aging tank 4 and the first artificial aging oven 6.

There is also provided eighth means, such as a multizoned second artificial aging oven 8, for performing a second artificial aging of the alloy. For example, the oven 8 may be an air oven placed on the roof of the facility or on some other structure above the ground floor level. Ninth means, such as an elevator 9, transfers the alloy from the first artificial aging oven 6 to the second artificial oven 8.

As shown in FIG. 2, at the left end or exit end of oven 8 there is provided an elevator-conveyor 10 for transferring the artificially aged alloy to a parallel rail process conveyor 11 which moves in a horizontal direction. The conveyor 11 normally carries fixtures holding the alloy from the lowerator or elevator-conveyor 10 to a water spray cool area 12 in less than a cycle period, which for the particular embodiment being described is approximately three minutes.

After the treated alloy has passed through the spray cool area 12, it passes to the unloading area 13.

The novel system described herein and as illustrated in FIG. 2 is designed for this particular embodiment go effect a stage change at approximately every three minutes. The alloy is initially loaded into the system by way of a horizontal conveyor 14 and a parallel chain transfer conveyor 15. In order to minimize wastage, and to maximize continuous process sequencing of the equipment, the present invention also contemplates a novel pre-programmed process sequence which will be described hereinbelow.

The particular example being described, it is assumed that each alloy piece weighs approximately nine pounds including the fixture for holding such piece, and that it is desired to process 6,000 such pieces in each 16-hour day. Thus, there would be a desired processing of 3,375 pounds per hour.

The process time described herein is based on sample "E". The total solution heat treat furnace time would be 20 minutes. The solution heat treat tank 1 would have seven working positions plus one extra position giving a total of eight positions. The quench tank 2 would have one working position plus one giving a total of two positions. The total quench time would be twenty seconds and would give a quench rate of 180° per second. For the particular sample "E", the quenching media was a salt mixture maintained at 350° F with the addition of certain amounts of water. However, the present invention contemplates any fluid quenching media as defined hereinabove. For example, the quenching media may be a molten salt composition including a salt selected from the group consisting of sodium nitrate, potassium nitrate, sodium nitrite, potassium nitrite, sodium chloride, and binary, ternary, quaternary and pentenary mixtures of the foregoing salts.

The natural aging tank 4 would have forty working positions plus one extra position giving a total of forty-one positions. For example "E", the total natural aging time would be two hours. The natural aging would take place at room temperature, and, if desired, may be performed in water with the use of ultrasonic vibrations taking place at approximately 20,000 cycles per second.

The first artificial aging step takes place in oven 6 which may have 30 working positions plus one giving a total of 31 positions. For this particular embodiment, the first artificial aging time would be 1½ hours in a convection air oven. Alternately, the artificial aging can take place in a salt or other liquid solution. For this embodiment, the first artificial aging temperature was 250° F. The artificial aging oven 6 may have three zones designated H, I, and J.

A parallel rail horizontal process conveyor 16 transfers the alloy pieces between the equipment 1–7, 9 and 15.

The second artificial aging oven 8 may have 60 working positions plus one giving a total of 61 positions. The second artificial aging time is three hours and the oven 8 may be provided with zones designated A, B, C, D, E, F and G.

There will now be described the sequence for an automatic shutdown of the equipment. The solution heat treat bath must be emptied.

Approximately 24 minutes prior to the shift end time or shutdown, the conveyor 14 stops and changes the conveyor 11 to an index cycle to accumulate 48 fixtures from oven 8. This assumes that too much natural aging would decrease the physical properties of the resultant alloy.

Conveyors 11, 17 and 16 continue to index 48 times to clear the solution heat treat furnace 1 and the natural aging tank 4.

There is than provided a program shutdown of the ovens. Zones A-G of artificial aging oven 8 shut down as the age timing for the product in the respective zone is completed, i.e., zone A then zone B then zone C, etc. Zones J, I and H of oven 6 are increased in temperature to the temperature of oven 8 to complete the aging process. Then, zones J, I and H shut down. Thus, the total facility has shut down and will cool to room temperature with fixtures in all positions except the furnace 1, the quench tank 2, and the natural aging tank 4.

The present invention also provides the following automatic sequence shift start-up procedure.

With clean or untreated parts on the load conveyor 14, the positions of the furnace 1 and the natural aging tank 4 are filled in 124 minutes (48 times 3 minutes). All conveyors are indexed.

As the zones of the artificial aging oven 6 are filling, heat is applied to zone H, then to zone I, then to zone J.

The zones G-A of oven 8 are programmed to temperature.

Approximately 180 minutes later the last finished fixture from the shutdown procedure has left oven 8 to the cooling conveyor 11.

Approximately 144 minutes later the conveyor 11 is emptied and is switched back to "fast transfer". All is not complete at "process" time and temperature.

One aspect of the present invention involves the use of ultrasonic energy in the quenching media, in the time period after quenching, in the natural aging step, and in the first artificial aging step. For example, the salt tank 2 used for quenching could contain ultrasonic energy sources to stimulate "from solution" precipitation of alloy intermetallic compound to effect a hardening. Alternatively, the room temperature or below natural aging or nucleation, time could be reduced by the use of ultrasonic energy induced into the parts of an aqueous solution prior to artificial aging or during artificial aging. Also, the artificial aging cycle could be reduced by the use of ultrasonics in a salt aqueous solution at temperatures greater than 400° F.

It has been discovered that the use of salt bath equipment and especially salt bath quenching rather than air quenching, increases the physical properties of the metals being treated and certainly reduces the floor space and capital cost for a total heat treat system.

In its simplest form, the present invention contemplates a total molten salt bath with a unique salt quench system rather than convection ovens and air quench techniques as mentioned hereinabove.

Molten salt heats metal four to six times faster than convection hot air. Heat is transferred by conduction and convection rather than by radiation and convection as in an air oven. Thus, the solution heat treat furnace 1 occupies less floor space.

Following the solution heat treat step, the aluminum alloy parts may be quenched in a molten salt bath operating in a temperature range between 200° and 400° F. The salt quench, as opposed to the forced air quench, gives a faster cooling velocity than with forced air and yet minimizes distortion.

According to a preferred embodiment, the salt chemistry used in the quench would usually be a ternary mixture of sodium nitrate, potassium nitrate and potassium or sodium nitrite. The lowest melting eutectic containing no water would have a theoretical melting point of approximately 292° F. This melting point can be depressed by making water additions to the salt mix. The use of this mix as a quenchant for aluminum alloys is considered unique.

The present invention also provides various side benefits with respect to the conservation of energy. As opposed to the wasting or throwing away of the heat to the atmosphere and forced air quenching equipment, with the present invention the heat removed from the assemblies or alloy would go into the salt and be used to maintain the salt temperature.

Conventional heat treatment of aluminum alloys requires that the parts be loosely separated in the solution heat treat oven and the forced air quench. In order to minimize the size of the artificial aging oven, the parts are rehandled after cooling to room temperature onto nesting fixtures to increase the density loading. The present invention eliminates this second handling. In other words, the parts would be more closely nested in the solution heat treating salt bath furnace 1 and the salt quench 2, and yet still assuring uniform heating and quenching to minimize distortion. The same fixture could be automatically transferred after salt quenching and air cooling to the aging salt bath furnace.

It will be evident from the description set forth hereinabove that there is here provided a novel method, system, apparatus and product obtained by using the novel method which satisfies all of the objects of the present invention, as well as others, including many advantages of great practical utility and commercial importance.

Furthermore, because many embodiments may be made of this inventive concept, and because many modifications and variations may be made of the particular embodiments hereinbefore shown and described, it is to be understood that all matter herein is to be interpreted merely as a lustrative, and not in a limiting sense.

I claim:

1. A method for heat treating a metallic substance, comprising the steps of:
solution heat treating said metallic substance by causing contact between said metallic substance and a predetermined fluid solution-heat-treat media;
quenching the solution heat treated metallic substance by causing contact between said solution heat treated metallic substance and a predetermined fluid quenching media;
subjecting said metallic substance to a predetermined ultrasonic treatment during said quenching step;
naturally aging said metallic substance; and
artificially aging said metallic substance.

2. A method for heat treating a metallic substance, comprising the steps of:
solution heat treating said metallic substance by causing contact between said metallic substance and a predetermined fluid solution-heat-treat media;
quenching the solution heat treated metallic substance by causing contact between said solution heat treated metallic substance and a predetermined fluid quenching media;
subjecting said metallic substance to a predetermined ultrasonic treatment after said quenching step;
naturally aging said metallic substance; and
artificially aging said metallic substance.

3. A method for heat treating a metallic substance, comprising the steps of:
solution heat treating said metallic substance by causing contact between said metallic substance and a predetermined fluid solution-heat-treat media;
quenching the solution heat treated metallic substance and a predetermined fluid quenching media;
naturally aging said metallic substance;
subjecting said metallic substance to a predetermined ultrasonic treatment during said naturally aging step; and
artificially aging said metallic substance.

4. A method for heat treating a metallic substance, comprising the steps of:
solution heat treating said metallic substance by causing contact between said metallic substance and a predetermined fluid solution-heat-treat media;
quenching the solution heat treated metallic substance by causing contact between said solution heat treated metallic substance and a predetermined fluid quenching media;
subjecting said metallic substance to a first predetermined ultrasonic treatment during said quenching step;
naturally aging said metallic substance;
artificially aging said metallic substance; and
subjecting said metallic substance to a second predetermined ultrasonic treatment prior to said artificially aging step.

5. A method for heat treating a metallic substance, comprising the steps of:
solution heat treating said metallic substance by causing contact between said metallic substance and a predetermined fluid solution-heat-treat media;
quenching the solution heat treated metallic substance by causing contact between said solution heat treated metallic substance and a predetermined fluid quenching media;
naturally aging said metallic substance; and
artificially aging said metallic substance; and wherein
said metallic substance comprises a non-ferrous alloy; and
the total time for performing the entire method is less than ten hours.

6. A method for heat treating a metallic substance, comprising the steps of:
solution heat treating said metallic substance by causing contact between said metallic substance and a predetermined fluid solution-heat-treat media;
quenching the solution heat treated metallic substance by causing contact between said solution heat treated metallic substance and a predetermined fluid quenching media; and wherein
said metallic substance comprises an aluminum alloy and including the steps of:
solution heat treating said aluminum alloy by emersing said aluminum alloy in a molten salt media for approximately 20 minutes;
quenching the solution heat treated aluminum alloy by emersing said solution heat treated alloy in a predetermined molted salt quenching media;
said predetermined molten salt quenching media including a salt selected from the group consisting of sodium nitrate, potassium nitrate, sodium nitrite, potassium nitrite, sodium chloride, and binary, ternary, quaternary and pentanary mixtures of the foregoing salts;
naturally aging said aluminum alloy for no more than four hours;
first artificially aging said aluminum alloy for no more than three hours at a first predetermined artificial aging temperature; and
second artificially aging said aluminum alloy for no more than six hours at a second predetermined artificial aging temperature.

7. A metallic substance which has been heat treated in accordance with a method comprising the steps of solution heat treating a metallic substance by causing contact between said metallic substance and a predetermined fluid solution-heat-treat media, quenching the solution heat treated metallic substance by causing contact between said solution heat treated metallic substance and a predetermined fluid quenching media, naturally aging said metallic substance, and artificially aging said metallic substance.

8. A metallic substance which has been heat treated in accordance with the method set forth in claim 1.

9. A metallic substance which has been heat treated in accordance with the method set forth in claim 2.

10. A metallic substance which has been heat treated in accordance with the method set forth in claim 3.

11. A metallic substance which has been heat treated in accordance with the method set forth in claim 4.

12. A metallic substance which has been heat treated in accordance with a method comprising the steps of solution heat treating said metallic substance by causing contact between said metallic substance and a predetermined fluid solution-heat-treat media, quenching the solution heat treated metallic substance by causing contact between said solution heat treated metallic substance and a predetermined fluid quenching media, maintaining said predetermined fluid quenching media at a temperature which is as high as possible to minimize distortion of said metallic substance and which is low enough to obtain sufficient quenching of said metallic substance, naturally aging said metallic substance, and artificially aging said metallic substance.

13. A metallic substance which has been heat treated in accordance with the method set forth in claim 5.

14. A metallic substance which has been heat treated in accordance with the method set forth in claim 6.

15. A system for carrying out a method for heat treating a metallic substance comprising the steps of solution heat treating said metallic substance by causing contact between said metallic substance and a predetermined fluid solution-heat-treat media, quenching the solution heat treated metallic substance by causing contact between said solution heat treated metallic substance and a predetermined fluid quenching media, naturally aging said metallic substance, and artificially aging said metallic substance, comprising, in combination:

first means for solution heat treating said metallic substance;

second means for quenching the solution heat treated metallic substance;

third means for transferring the solution heat treated metallic substance between said first means and said second means;

fourth means for naturally aging the quenched metallic substance;

fifth means for transferring the quenched metallic substance between said second means and said fourth means;

sixth means for performing a first artificial aging of the naturally-aged metallic substance;

seventh means for transferring the naturally-aged metallic substance between said fourth means and said sixth means;

eighth means for performing a second artificial aging of the metallic substance; and ninth means for transferring the metallic substance between said sixth means and said eighth means.

16. A system for carrying out the method for heat treating a metallic substance substantially in accordance with the method of claim 5, comprising, in combination:

first means for solution heat treating a metallic substance;

second means for quenching the solution heat treated metallic substance;

third means for transferring the solution heat treated metallic substance between said first means and said second means;

fourth means for naturally aging the quenched metallic substance;

fifth means for transferring the quenched metallic substance between said second means and said fourth means;

sixth means for performing a first artificial aging of the naturally-aged metallic substance;

seventh means for transferring the naturally-aged metallic substance between said fourth means and said sixth means;

eighth means for performing a second artificial aging of the metallic substance; and ninth means for transferring the metallic substance between said sixth means and said eighth means.

* * * * *